US006397954B1

(12) United States Patent
Liu

(10) Patent No.: US 6,397,954 B1
(45) Date of Patent: Jun. 4, 2002

(54) SEAL MEMBER FOR A CYLINDER OF A PNEUMATIC TOOL

(75) Inventor: Jason Liu, Taichung (TW)

(73) Assignee: Basso Industry Corp, Taichung City (TW)

( * ) Notice: Subject to any disclaimer, the term of this patent is extended or adjusted under 35 U.S.C. 154(b) by 0 days.

(21) Appl. No.: 09/566,494

(22) Filed: May 8, 2000

(51) Int. Cl.[7] ..... B25D 1/02
(52) U.S. Cl. ..... 173/93.5; 173/168
(58) Field of Search ..... 173/93, 93.5, 93.6, 173/109, 168, 169

(56) References Cited

U.S. PATENT DOCUMENTS 4,708,210 A * 11/1987 Rahm ..... 173/169
4,905,772 A * 3/1990 Honsa et al. ..... 173/162.1
5,524,715 A * 6/1996 Kimberlin et al. ..... 173/168

* cited by examiner

*Primary Examiner*—Scott A. Smith
*Assistant Examiner*—Nathaniel Chukwurah
(74) *Attorney, Agent, or Firm*—Charles E. Baxley

(57) ABSTRACT

A seal member for a pneumatic tool is a flexible ring mounted to a ring-shaped cylinder in which a rotary piston is rotatably engaged. The cylinder has an inlet and an outlet radially defined therethrough. Two pairs of ribs respectively extend radially outward from the cylinder and the first inlet is located between one of the two pairs of ribs and the outlet inlet is located between the other pair of the two ribs. The seal member has a first hole communicating with the inlet and a second hole communicating with the outlet. The first hole is enclosed by a first flange and the second hole is enclosed by a second flange. One pair of the ribs is engaged with and enclosed by the first flanges the other pair of ribs is engaged with and enclosed by the second flange.

2 Claims, 5 Drawing Sheets

SEAL MEMBER FOR A CYLINDER OF A PNEUMATIC TOOL

FIELD OF THE INVENTION

The present invention relates to a seal member for a cylinder of a pneumatic tool and the seal member is a flexible collar mounted to the cylinder. The seal device has flanges engaged with ribs on an outside of the cylinder so that the seal member is securely mounted to the cylinder.

BACKGROUND OF THE INVENTION

A conventional driving device for a pneumatic tool is shown in FIG. 1 and generally includes a head 10 connected to a base 15, a cylinder 13 is located between the head 10 and the base 15, and a rotary piston 14 rotatably received in the cylinder 13. The head 10 has an inlet tube 11 and an outlet tube 12 respectively extending outward from the head 10. A plurality of blades 141 extend radially outward from the rotary piston 14 and are engaged with an inside of the cylinder 13. An inlet hole 131 and an outlet hole 132 are respectively defined through the cylinder 13 so that the rotary piston 14 can rotate in the piston 13 by air entering into the piston via the inlet hole 131 and releasing from the cylinder 13 via the outlet hole 132. The efficiency of the cylinder 13 is affected by sealing between the cylinder 13 and the inside of the head 10. Unfortunately, the conventional sealing device is a seal ring mounted to the cylinder 13. The sealing ring only roughly seals a periphery of the cylinder 13 and this is not enough. However, the cylinder 13 usually shifted by vibration of the tool so that the positions of the inlet hole 131 and the outlet hole 132 are shifted and thereby resulting leakage.

The present invention intends to provide a seal member that is made of flexible material and securely mounted to the cylinder so as to establish a good sealing feature for the cylinder.

SUMMARY OF THE INVENTION

In accordance with one aspect of the present invention, there is provided a combination of a seal member and a cylinder for a pneumatic tool and comprising a ring-shaped cylinder in which a rotary piston is rotatably engaged. An inlet and an outlet are radially defined through the cylinder. Two first ribs respectively extend radially outward from the cylinder, and the first inlet is located between the two first ribs. Two second ribs respectively extend radially outward from the cylinder and the outlet inlet is located between the two second ribs. A seal member is mounted to the cylinder and has first hole and a second hole defined therethrough. A first flange extends radially outward from the seal member and the first hole is enclosed by the first flange. A second flange extends radially outward from the seal member and the second hole is enclosed by the second flange. The first inlet communicates with the first hole and the second inlet communicates with the second hole. The first ribs are engaged with and enclosed by the first flange, and the second ribs are engaged with and enclosed by the second flange.

The object of the present invention is to provide a seal member securely mounted to the ring-shaped cylinder by engaging flanges on the seal member with the ribs extending from the cylinder.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
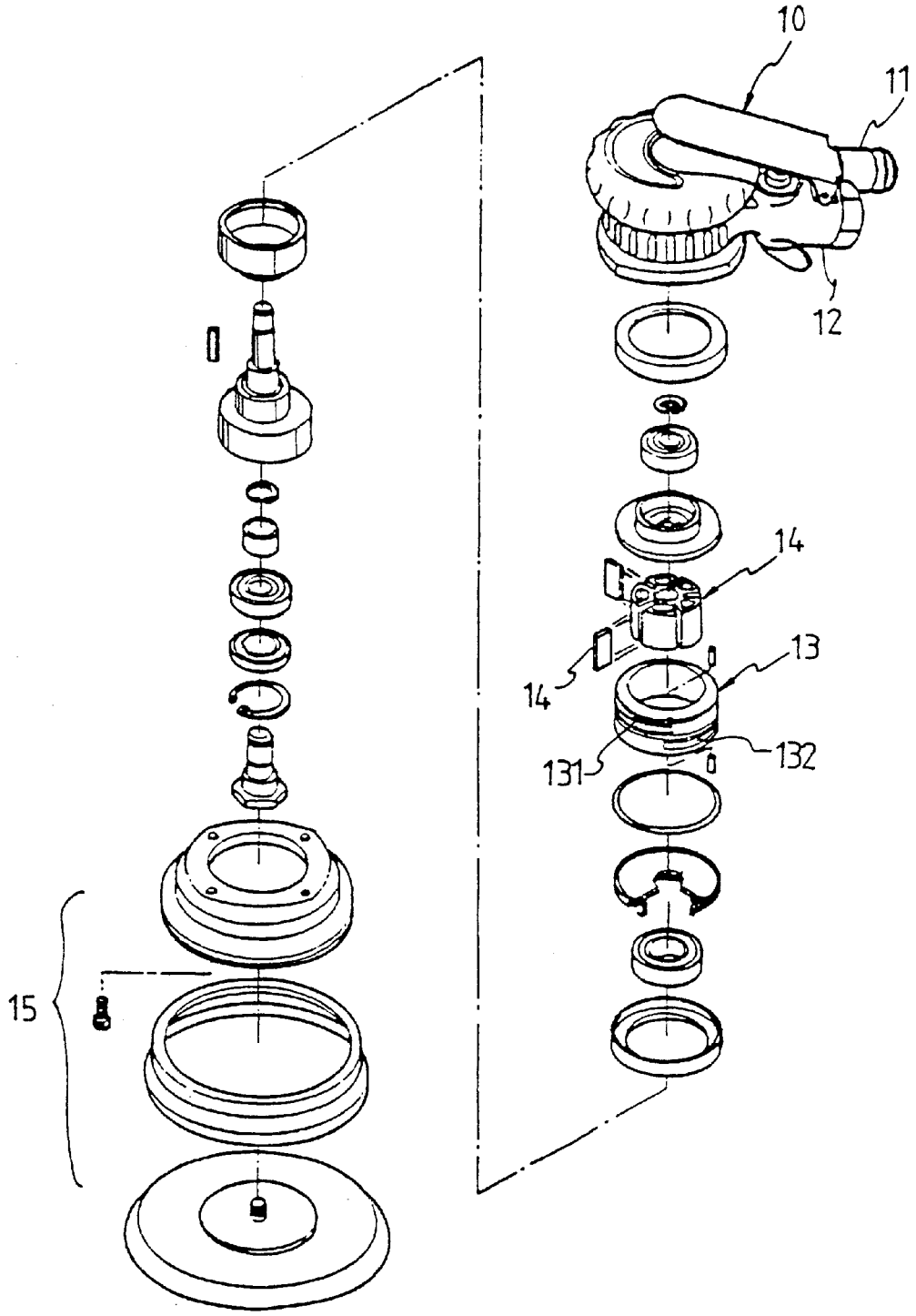
FIG. 1 PRIOR ART
FIG. 1 is an exploded view to show a conventional pneumatic tool.
Figure 2:
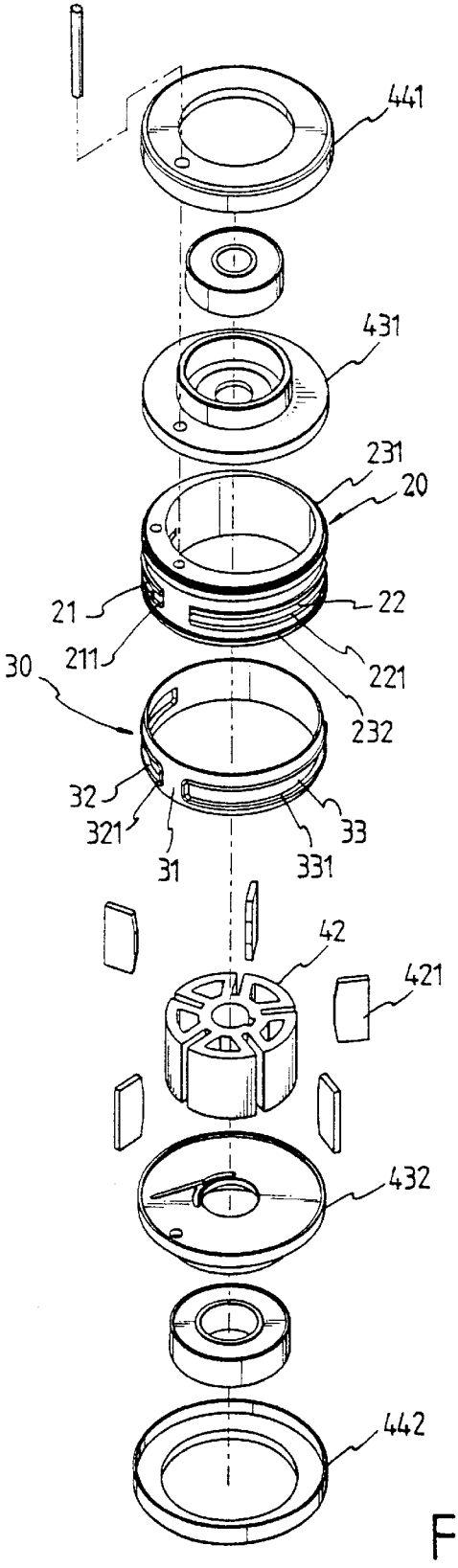
FIG. 2 is an exploded view to show a combination of a cylinder and a seal member of the present invention.
Figure 3:
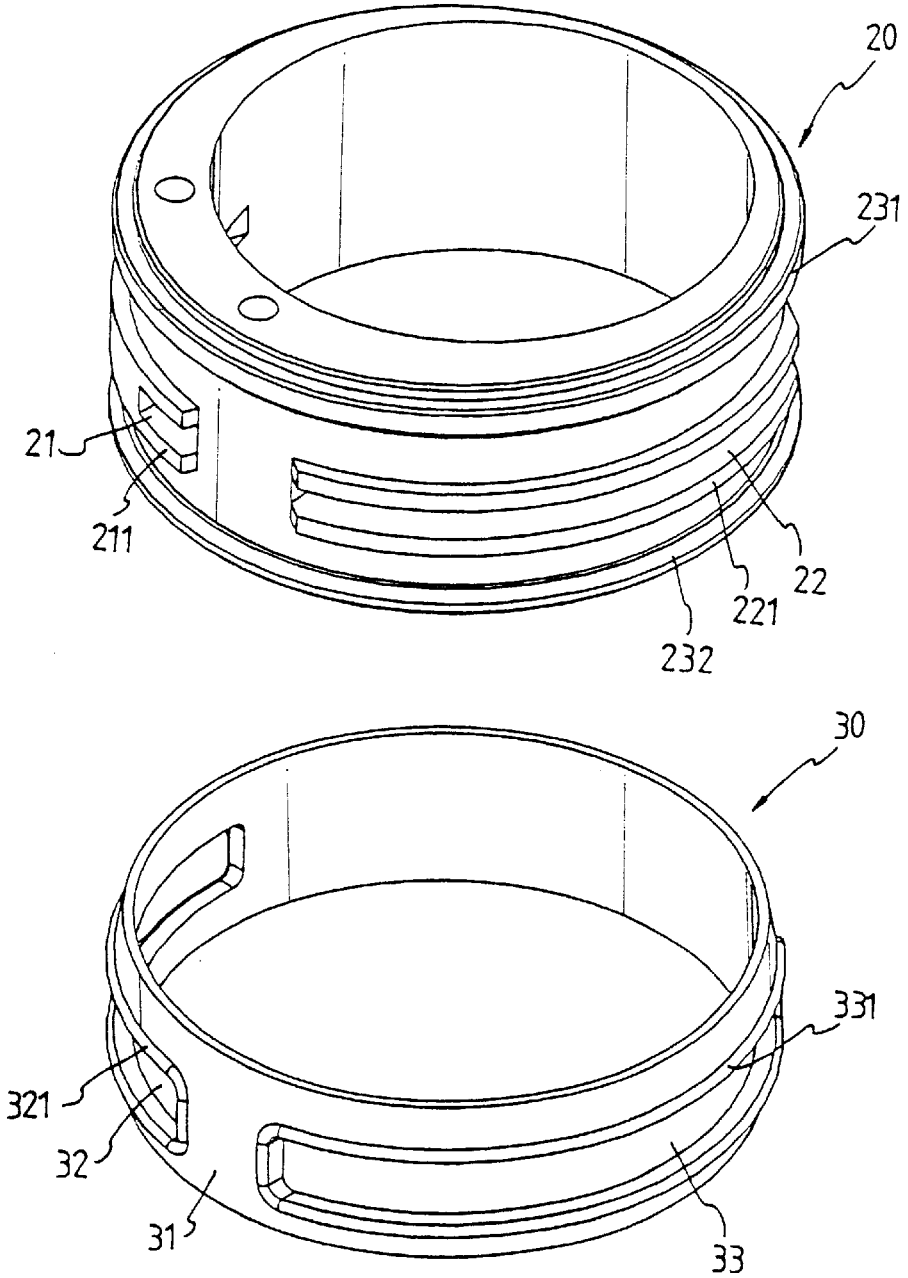
FIG. 3 is a perspective view to show the cylinder and the seal member of the present invention.

Referring to FIGS. 2 and 3, a cylinder 20 for a pneumatic tool is a ring-shaped cylinder 20 and a rotary piston 42 is rotatably engaged with an inside of the cylinder 20. Five blades 421 extend radially outward from the rotary piston 42. An inlet 21 and an outlet 22 are radially defined through the cylinder 20 so that the pressurized air enters in the cylinder 20 from the inlet 21 and releases from the cylinder 20 via the outlet 22, and the air pushes the blades 421 to rotate the rotary piston 42. Two first ribs 211 respectively extend radially outward from the cylinder 20 and the first inlet 21 is located between the two first ribs 211. Two second ribs 221 respectively extend radially outward from the cylinder 20 and the outlet inlet 22 is located between the two second ribs 221. Two engaging flanges 231, 232 respectively extend radially outward from two ends of the cylinder 20. The cylinder 20 is retained between an upper cap 441 and a lower cap 442. A first bearing frame 431 with a bearing mounted thereto is located between the upper cap 441 and the cylinder 20. A second bearing frame 432 with a bearing mounted thereto is located between the lower cap 442 and the cylinder 20.

Figure 4:
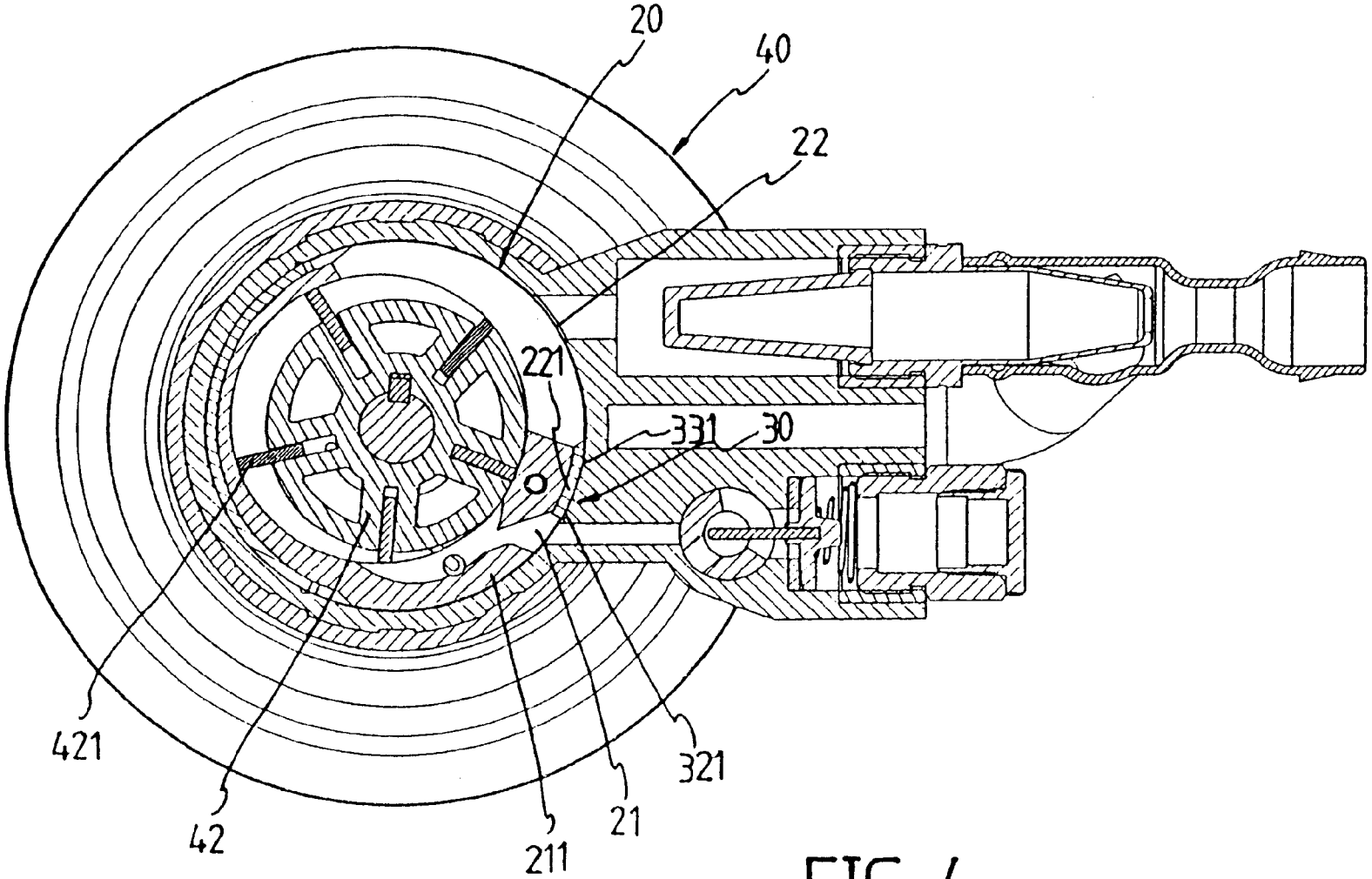
FIG. 4 is a top cross sectional view to show a pneumatic tool having the seal member of the present invention received therein.
Figure 5:
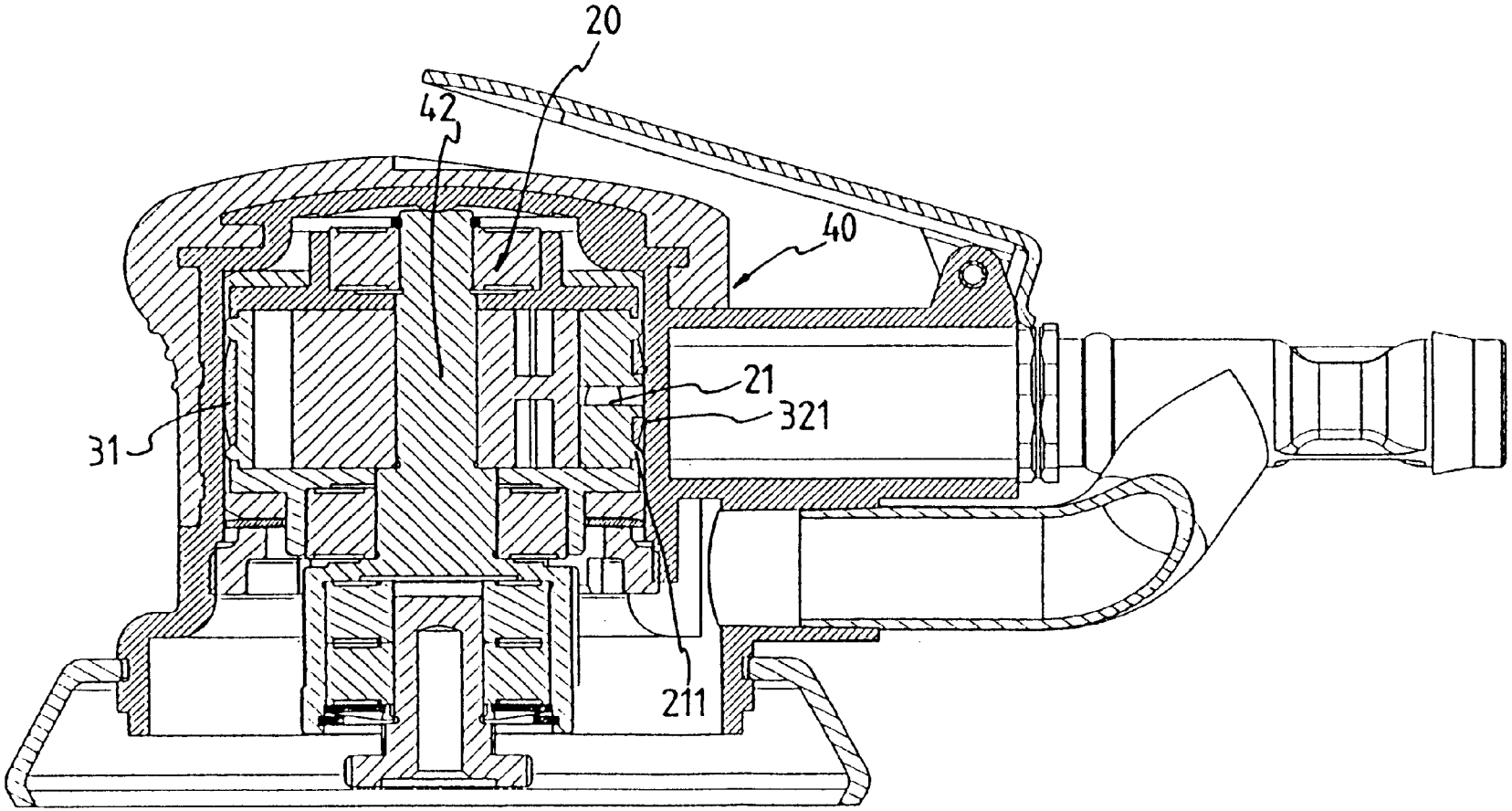
FIG. 5 is a side elevational view, partly in section, of the pneumatic tool with the seal member of the present invention.

Further referring to FIGS. 4 and 5, a seal member 30 made of flexible material is mounted to the cylinder 20 and is retained between the two engaging flanges 231, 232. A first hole 32 and a second hole 33 are respectively defined through the seal member 30. A first flange 321 extends radially outward from the seal member 30 and the first hole 32 is enclosed by the first flange 321. A second flange 331 extends radially outward from the seal member 30 and the second hole 33 is enclosed by the second flange 331. The first inlet 21 communicates with the first hole 32 and the second inlet 22 communicates with the second hole 33. The first ribs 211 are engaged with and enclosed by the first flange 321, and the second ribs 221 are engaged with and enclosed by the second flange 331.

The seal member 30 is securely mounted to the cylinder 20 because the first ribs 211 are engaged with and enclosed by the first flange 321, and the second ribs 221 are engaged with and enclosed by the second flange 331 so that when the tool is operated, vibration will not shift the seal member 30. By this arrangement, leakage will be effectively avoided.

While we have shown and described various embodiments in accordance with the present invention, it should be clear to those skilled in the art that further embodiments may be made without departing from the scope and spirit of the present invention.

What is claimed is:

1. A combination of a seal member and a cylinder for a pneumatic tool comprising:

a cylinder being a ring-shaped member and a rotary piston rotatably engaged with an inside of said cylinder, an inlet and an outlet radially defined through said cylinder, two first ribs respectively extending radially outward from said cylinder and said first inlet located between said two first ribs, two second ribs respectively extending radially outward from said cylinder and said outlet inlet located between said two second ribs, and a seal member mounted to an outside of said cylinder, a first hole and a second hole respectively defined through said seal member, a first flange extending radially outward from said seal member and said first hole enclosed by said first flange, a second flange extending radially outward from said seal member and said second hole enclosed by said second flange, said first inlet communicating with said first hole and said second inlet communicating with said second hole, said first ribs engaged with and enclosed by said first flange, said second ribs engaged with and enclosed by said second flange.

2. The combination as claimed in claim 1 further comprising two engaging flanges respectively extending radially outward from two ends of said cylinder, said seal member being retained between said two engaging flanges.

* * * * *